United States Patent [19]

Lawrence et al.

[11] 4,400,148

[45] Aug. 23, 1983

[54] RECOVERY OF FINES IN AIR LAID PAPERMAKING

[75] Inventors: William J. Lawrence; Patrick W. Halferty, both of Green Bay, Wis.

[73] Assignee: James River-Dixie/Northern, Inc., Greenwich, Conn.

[21] Appl. No.: 263,121

[22] Filed: May 13, 1981

[51] Int. Cl.[3] ..... D04H 1/64

[52] U.S. Cl. ..... 425/155; 264/37; 264/121; 425/80.1; 425/83.1; 425/159

[58] Field of Search ..... 425/155, 159, 80.1, 425/83.1; 264/37, 121

[56] References Cited

U.S. PATENT DOCUMENTS

| | | | |
|---|---|---|---|
| 3,074,834 | 1/1963 | Matlin et al. | 154/46 |
| 3,692,622 | 9/1972 | Dunning | 428/171 |
| 3,825,381 | 7/1974 | Dunning et al. | 425/82.1 |
| 3,976,734 | 8/1976 | Dunning et al. | 264/89 |

*Primary Examiner*—Maurice J. Welsh

*Attorney, Agent, or Firm*—Isaksen, Lathrop, Esch, Hart & Clark

[57] ABSTRACT

Improved air laid papermaking is disclosed in which the fine particles which pass through the forming wire are, after collection by a baghouse separator, delivered back to the papermaking machine for incorporation in the web being formed by the machine. A plurality of individual separator units within the baghouse are sequentially discharged so that a substantially constant feedback of fines to the papermaking machine is obtained. The fines are fed back to a selected one of the distributors of the papermaking machine to be distributed to the surface of the web being formed at a position downstream of the position at which fibers are initially laid on the wire, thereby trapping the fines on the surface of the previously laid mat of fibers such that very little of the fines pass through the forming wire at this position. Damper valves connected to the hoppers of the individual separator units are controlled to automatically open in sequence to discharge the collected fines to conduits which are arranged in a manifold configuration leading back to a single collection conduit on which constant suction draw is provided by a transport fan. The output of the transport fan is directed to the selected distributor, which also receives the fiber and air from the main defibrator so that the fines are mixed with longer fibers before being supplied to the forming wire.

13 Claims, 3 Drawing Figures

RECOVERY OF FINES IN AIR LAID PAPERMAKING

TECHNICAL FIELD

This invention pertains generally to the field of papermaking by the air laying process, and particularly to methods and apparatus for recovering and using the fine fibers within the supply stock.

BACKGROUND ART

In a typical air laid papermaking process a dried mat of fibers is broken up to free the individual fibers which are then carried by air flow to a distributor and applied to a moving forming wire. A suction box beneath the distributor pulls the fibers down onto the wire to aid in the forming of the web. After the web is laid, it is typically compressed somewhat and then strengthened by the addition of liquid binders which, when cured, hold the fibers of the web together. Such air laying processes and numerous variations thereof are well known in the art.

It is also well known that when the mat of fibers is pulverized many fibers are formed which are smaller than the openings in the forming wire or fabric and thus pass through the wire. The fine particles are carried from the suction box along with the suction air to the main suction fan and are then delivered under pressure to an air cleaner or separator. A standard type of separator uses several fiber collection units having cloth tubes descending downwardly from an intake plenum into which the fiber bearing air is discharged. The air passes through the walls of the cloth tubes and is discharged to the outside while the fines are collected on the surfaces of the tubes. Such a collection apparatus is customarily referred to in the trade as a baghouse and further includes chutes or hoppers which are mounted under each of the separator units. These chutes are ordinarily closed at their bottoms with a damper but are periodically opened to discharge the contents of the separator tubes into a collection receptacle such as a plastic bag. In large baghouses containing a number of separator units, each having a plurality of cloth tubes, the individual units are discharged one at a time by cutting off the air flow to the unit being discharged and shaking the tubes of the unit to cause the fibers to drop away from the surfaces of the tubes into the hoppers.

The fines collected from the separator have been treated as refuse and packaged for dumping in land fills or burned. A significant economic loss results, since 6% to 7% of the air layed fiber stock commonly consists of fines, and disposal of the collected fines requires significant human labor to package the fines and transport it to waste disposal sites. The handling of the discarded fines also inevitably results in an increase in the level of fines discharged to the atmosphere in the area surrounding the fiber separator, presenting a potential health hazard to workers.

DISCLOSURE OF THE INVENTION

The present invention recycles the fine particles collected by the fiber separator back to the papermaking machine for incorporation in the air laid web in a manner which significantly improves the operation of present air laid papermaking machines and their associated fines collectors and separators. The apparatus operates automatically—no attendants are normally need to remove the collected fines and recycle them to the papermaking machine; the fines are kept completely enclosed during the entire cycle, thereby greatly reducing the dust particles in the air surrounding the separator and the papermaking machine; and the recycling of the fines back to the paper product allows a greater volume of paper product to be produced from a quantity of raw material than was previously possible.

In accordance with the present invention, it has been discovered that by distributing the fines from the separator onto the forming wire at a position down stream of the initial laying of fibers onto the wire, the fine particles are held on the surface of the previously formed mat of longer fibers and do not pass through the forming wire in substantial quantities. The recycled fines are mixed with the longer "fresh" fibers coming directly from the pulverizing mill or defibrator so that they are somewhat physically entangled within the web by the longer fibers, and the fines are subsequently "fixed" within the web by application of binding latex which holds the fines to the web after the binder has been cured.

The apparatus of the invention includes transfer conduits connected to the bottom of each of the hoppers of the separator to receive the discharge and connected together in a manifold arrangement to direct the discharge from each hopper to a common collection conduit. Output damper valves are mounted in the manifold conduits adjacent the bottom of each hopper and are responsive to a control signal to open to allow passage of the fines through the manifold conduits. A transport fan continuously operates to place a draw on the collection conduit, and thereby on all of the manifold conduits, and delivers the fines to an outlet conduit leading from the transport fan to a humidification hood of a distributor of the papermaking machine which also receives air and fresh fiber from the hammermill or defibrator. The longer fibers from the defibrator and the recycled fines are mixed together in air suspension within the distributor before the mixture is laid on the forming wire.

The air carrying the recycled fines is directed to a particular one of the distributors of the multi-distributor papermaking machine such that the fines are deposited on the forming wire at a position downstream from the position at which fibers are first laid on the forming wire. At the downstream location the previously laid fibers form a mat dense enough to trap substantially all of the fines which are deposited thereon. Of course, any fines that do ultimately again pass through the forming wire are drawn in to the suction boxes and thence to the separator and are passed through the recovery cycle once again.

The flow of fines delivered to the papermaking machine is maintained substantially constant when the machine is in continuous operation by sequentially discharging each one of a plurality of separator units within the baghouse. If there are a reasonably large number of such units, as there ordinarily are to provide proper cleansing of the air drawn from a large air laid papermaking machine, each unit will have sufficient time to accumulate a substantial quantity of fines before it is again discharged in its normal sequence. The sequencing of the discharge of the individual separator units can easily be controlled to provide a substantially constant flow of the fine particles to the papermaking machine to thereby maintain relatively uniform web consistency.

Because the transport fan is continuously operating during operation of the papermaking machine, any fines accumulating within the various hoppers or manifold conduits will naturally tend to be drawn toward the fan, and will not tend to be discharged out into the surrounding atmosphere—a common occurrence with prior baghouse discharge procedures wherein the bottom of each hopper is closed by a damper that is constantly under air pressure, resulting in an inevitable leakage of fine particles out into the atmosphere.

Further objects, features and advantages of the invention will be apparent from the following detailed description taken in conjunction with the accompanying drawings showing a preferred embodiment of the invention.

BEST MODE FOR CARRYING OUT THE INVENTION

Figure 1:
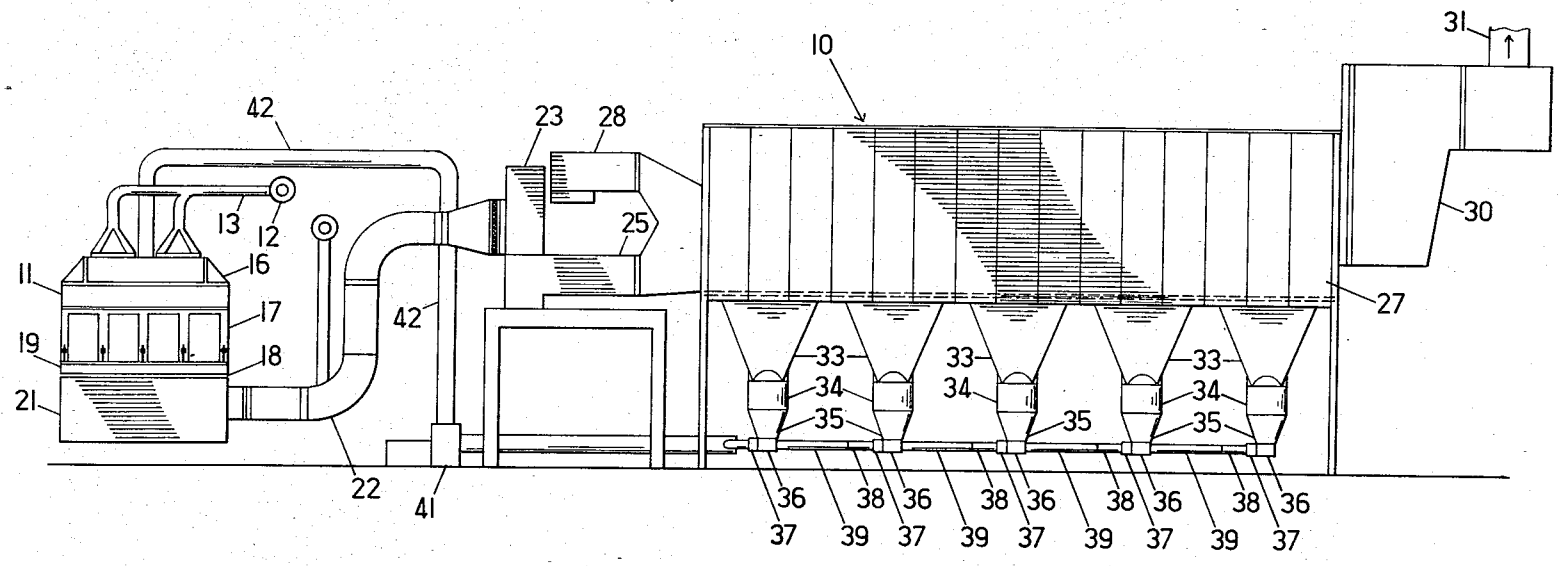
FIG. 1 is a somewhat simplified side elevation view of papermaking and fines separation equipment incorporating apparatus in accordance with the invention for recycling the collected fine particles back to the papermaking machine.

With reference to the drawings, a preferred embodiment of the apparatus of the invention as embodied in air laid papermaking equipment with associated separators is shown generally at 10 in FIG. 1. The apparatus 10 includes a papermaking machine showed in simplified cross-section at 11 which receives fiber and air from a defibrator, such as a pinmill or hammermill through a supply fan 12 and a supply duct 13. Humidified air from the ambient atmosphere is mixed with the air and fiber mixture in a humidification hood 16; a distributor 17 receives the air and fiber mixture from the humidification hood and passes it downwardly through a forming wire 18 which is in contact with a seal roll 19. Suction is supplied to the bottom of the forming wire by a suction box 21 which also collects the fines which pass through the forming wire. The fines and air mixture pass from the suction box through a return duct 22 to a main suction fan 23 and thence through a duct 25 to the main separator or baghouse 27. Ductwork 28 extends from the other suction boxes mounted beneath additional distributors (not shown in FIG. 1) which feed air and fiber mixture to the forming wire. It is understood that the particular distributor 17 shown in FIG. 1 is one of at least two distributors spaced sequentially along the forming wire to distribute fibers to the wire, and the distributor 17 shown in FIG. 1 is spaced downstream in the direction of forming wire travel from at least one prior fiber distributor.

The structure of the separator units within the baghouse 27 is conventional, such as commercial units produced by the G. A. Kleissler Company. The incoming air which is passed through the walls of the cloth tubes within the baghouse 27 is directed through an outlet duct 30 and a vertical duct 31 to the outdoors atmosphere. The internal construction of the baghouse 27 includes a plurality of separator units mounted in a grid, with each unit being built so that it can be individually discharged, thereby causing the collected fines to drop down through hoppers 33 mounted under the separation units. The fines discharged from the bottom outlet of each of the hoppers 33 passes through a cylindrical extension 34 and a funnel-like chute 35 to direct the discharged fines to a bottom collector 36 which is connected to a manifold conduit damper valve 37. The damper valves 37 are each preferably air operated, and each is connected through a stub transfer conduit 38 to a main line transfer conduit 39. The manifold conduit damper valves, when closed, provide a tight closeoff of communication between the transfer conduits and the hoppers and effectively control the flow of fines through the conduits. The main line conduits 39 are manifolded together and converge to a collection conduit 40 which receives the fines discharged from each of the hoppers 33. The collection conduit 40 thence leads to a transport fan unit 41 which is continuously operating to apply suction to the collection conduit 40 and to pass any air and particles collected up through an outlet conduit 42 back to the distributor 17.

Figure 2:
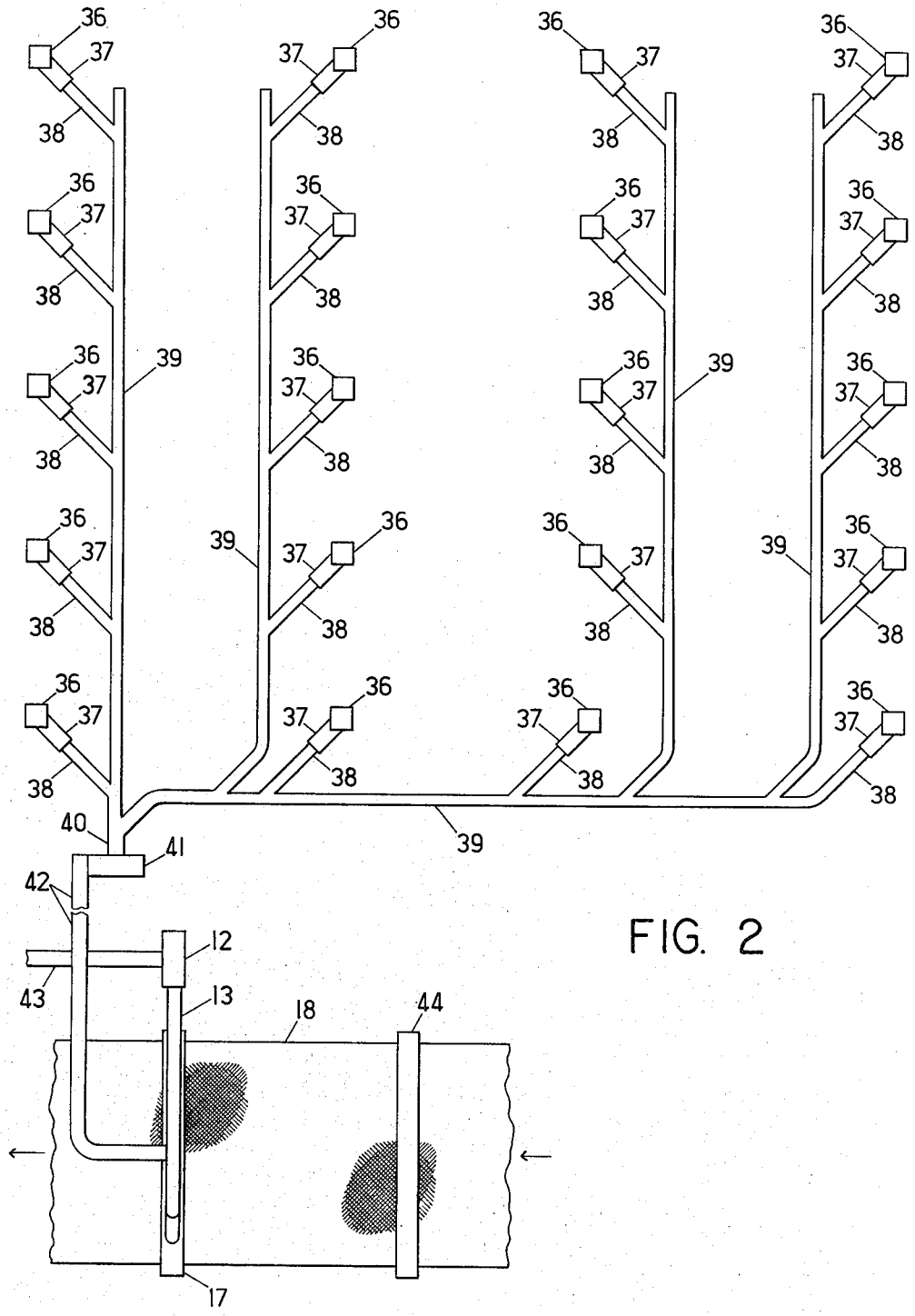
FIG. 2 is a top plan view of the conduits leading from the individual separator units back to the distributors of the papermaking machine.

The layout of the array of individual separation units is shown in the plan view of FIG. 2. The 4 by 5 array of separation units illustrated in FIG. 2, a total of 20 units, provides a system that allows the discharge from a single one of the units over a cycle time to be passed through the manifold conduits back to the papermaking machine 11. The air and fiber mixture which contains the fines is distributed to the forming wire 18 at a position which is downstream from a prior distributor shown schematically at 44 in FIG. 2.

Figure 3:
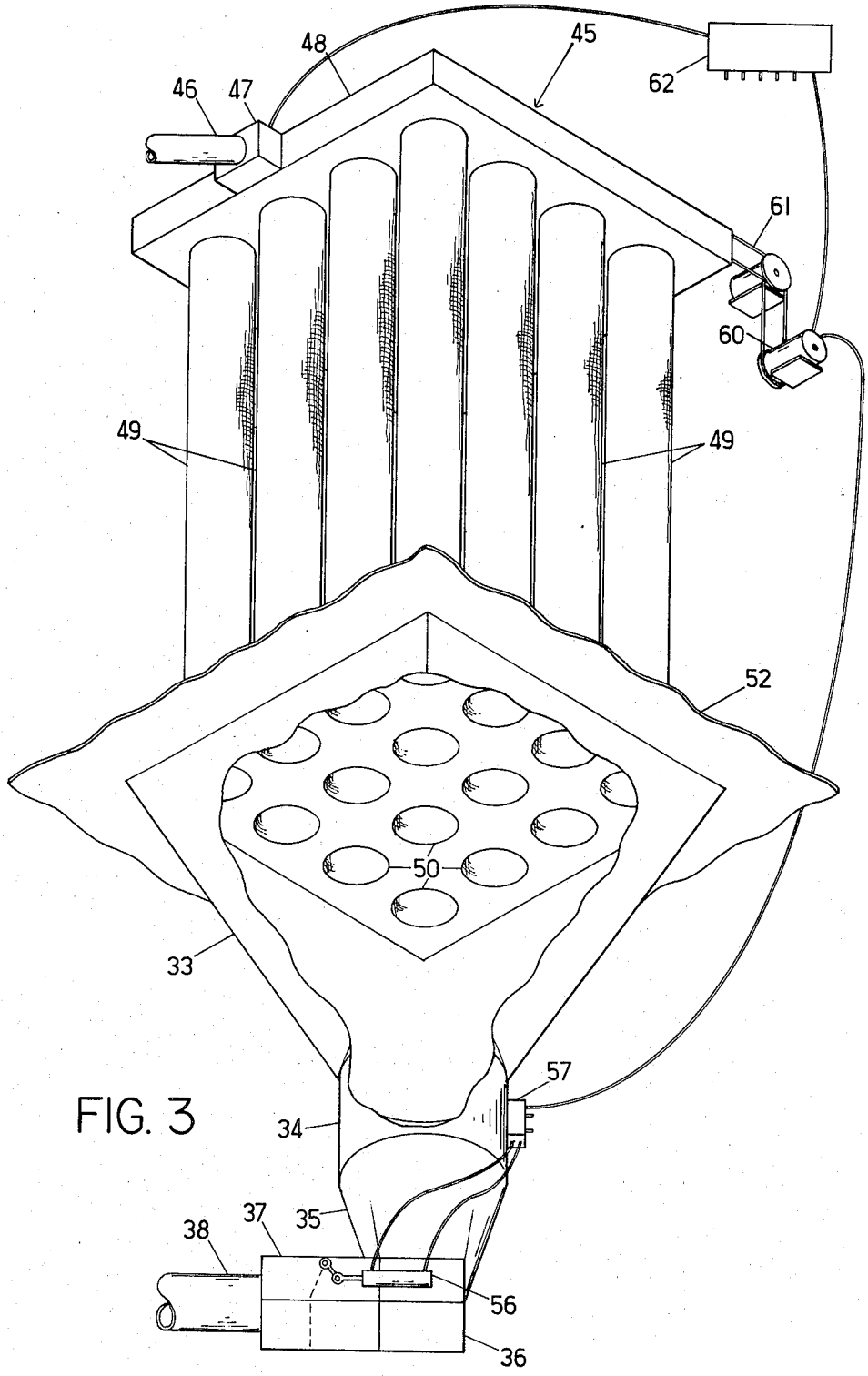
FIG. 3 is an isometric view of one separation unit and associated hopper and manifold conduits.

The construction of the separation units 45 within the baghouse enclosure 27 is illustrated in FIG. 3. An intake conduit 46 connected to the return duct 25 delivers the fines and air mixture through a main cutoff damper 47 to a plenum 48 at the top of the unit. The plenum is connected to a plurality of vertically suspended tubes 49, formed of a porous cloth or fabric, which allow air to pass through but trap the fine particles. The interior of each of the tubes 49 communicates with openings 50 formed in the floor 52 of the baghouse. The tubes 49 empty through the openings 50 into the hopper 33. Because the valve 37 operates normally to shut off the flow of air out of the hopper 33, no valve or damper is needed within the hopper. This provides a significant improvement in dust control over conventional baghouse hopper dampers having a manually operated slide gate around which fiber leaks occur. The damper valve 37 is opened and closed by a two-way air operated drive cylinder 56 which is supplied with the control pressure air which drives it from a solenoid operated valve 57. The plate type damper valve 37 shown in FIG. 3 is only illustrative of the types of valves that may be used. For example, an air operated pinch valve which provides no internal obstructions to the flow of air and fines is well suited to use as the damper valve.

When the particular separator unit or cell 45 is to be discharged, the main damper 47 is shut and an electric drive motor 60 is supplied with power and drives a shaker unit 61 which causes the plenum 48 and the tubes 49 to be shaken vigorously, thereby dislodging the fibers collected on the walls of the tubes and causing these fibers to drop into the hopper 33. The power that actuates the drive motor 60 is also supplied to the solenoid valve 57 to cause it to open to supply air pressure to the air cylinder 56 to open the valve 37. Substantially all of the fibers collected within the tubes 49 are discharged during a predetermined cycle time, after which the power is shut off to the motor 60 to stop the shaking of the unit, which simultaneously causes the solenoid valve 57 to shift and supply air pressure to the air cylinder 56 to close the damper valve 37.

With the utilization of a substantial number of separator units 45, such as the 20 units illustrated in FIG. 2, a 20 to 30 second cycle time for each cell provides sufficient time for the other cells in the array to collect quantities of fines such that, by sequentially cycling through each cell in the array, a substantially constant flow of fines can be fed back to the papermaking machine. The means for controlling the discharge of each separator unit 45 by closing of the main damper 47, activation of the motor 60, and the opening of the valve 37, in sequence, can be readily accomplished by timing relays or electronic timers contained within a controller unit 62, shown in FIG. 3, connected to supply control signal power to the main damper 47, drive motor 60 and solenoid 57 of each of the separator units 45. The number of separator units required will depend largely on the capacity required to adequately clean the suction air from the paper making machine; at least two are required to allow cycling, but the more units available, the more constant will be the flow rate of fines back to the paper machine.

It is understood that the invention is not confined to the particular construction and arrangement of parts herein illustrated and described, but embraces such modified forms thereof as come within the scope of the following claims.

We claim:

1. Apparatus for continuously recovering the fines collected from an air laid papermaking machine at a fines separator having a plurality of separation units which discharge said fines into hoppers, comprising:

(a) selectively openable manifold conduit damper valves, each connected to the bottom of one of the hoppers, normally blocking the flow of air and fines therethrough, each damper valve being responsive to a control signal to open and allow the contents from the hoppers of the separation units to pass therethrough;

(b) transfer conduits connected to receive fines passed through the manifold conduit damper valves, the conduits being arranged in a manifold configuration which converges to a collection conduit;

(c) a transport fan connected to the collection conduit to provide a continuous suction draw on the collection conduit and thereby on the other manifold conduits;

(d) an outlet conduit, connected to receive the air and fines mixed therewith from the transport fan, which extends to the papermaking machine and is adapted for connection to a distributor of the papermaking machine wherein fresh fiber stock is mixed with the fines.

2. The apparatus of claim 1 including control means for providing the control signal to the manifold conduit damper valves to open the valves in sequence to discharge the contents of the several separation units sequentially.

3. The apparatus of claim 1 wherein the transfer conduits include main line transfer conduits which converge to join the collection conduit and stub conduits leading from each manifold conduit damper valve to a main line transfer conduit.

4. The apparatus of claim 1 wherein the manifold conduit dampe valve is opened and closed by a drive cylinder.

5. The apparatus of claim 1 wherein the manifold conduit damper valves are opened and closed by an air operated drive cylinder, and including control means for providing air under pressure to the drive cylinders of the manifold conduit valves in proper sequence to sequentially open the valves beneath each separation unit to discharge the contents of the separation units one unit at a time.

6. In an air laid papermaking machine apparatus having a moving forming wire, multiple distributors supplying a mixture of fibers in air to the forming wire, at least one suction box beneath the forming wire to draw off the air from under the wire and draw away any fines passing through the forming wire, and a separator receiving the fines and air from the suction box which includes a plurality of separation units, each of which separates the fines from the air carrying the fines and collects the fines until the separation units are controlled to individually discharge the fines into hoppers, the improvement comprising:

selectively openable manifold conduit damper valves, each connected to the bottom of one of the hoppers, normally blocking the flow of air and fines therethrough, each damper valve being responsive to a control signal to open and allow the contents from the hoppers of the separation units to pass therethrough;

transfer conduits connected to receive fines passed through the manifold conduit damper valves, the conduits being arranged in a manifold configuration which converges to a collection conduit;

a transport fan connected to the collection conduit to provide a continuous suction draw on the collection conduit and thereby on the other manifold conduits;

an outlet conduit, connected to receive the air and fines mixed therewith from the transport fan, which extends to the papermaking machine and is connected to a selected distributor of the papermaking machine which is located at a position downstream of the position at which fiber stock is first laid on the forming wire, whereby the fines delivered back to the papermaking machine will tend to be held on the surface of a mat of fibers already laid on the forming wire rather than passing through the forming wire.

7. The apparatus of claim 6 including control means for providing the control signal to the manifold conduit damper valves to open the valves in sequence to discharge the contents of the several separation units sequentially.

8. The apparatus of claim 6 wherein the transfer conduits include main line transfer conduits which converge to join the collection conduit and stub conduits leading from each manifold conduit damper valve to a main line transfer conduit.

9. The apparatus of claim 6 wherein the manifold conduit damper valve is opened and closed by a drive cylinder.

10. The apparatus of claim 6 wherein each separator unit includes a main damper valve operable in response to a control signal to close off the supply of air and fines to each separation unit, and wherein the manifold conduit damper valves are opened and closed by an air operated drive cylinder, and including control means for providing a control signal to close the main damper valves and for providing air under pressure to the drive cylinders of the manifold conduit valves in proper sequence to sequentially open the valves beneath each separation unit and discharge the contents of the separation units one unit at a time.

11. The apparatus of claim 10 including a shaker motor responsive to the control signal from the control means to shake the separator unit and cause collected fines to be discharged into the hopper of the separation unit.

12. The apparatus of claim 6 wherein the papermaking machine includes a main supply fan which receives fiber and air from a defibrator and delivers it to the selected distributor to which recycled fines are delivered.

13. An improved air laid papermaking process comprising the steps of:

(a) air laying fresh fibers on a moving forming wire of a papermaking machine;
(b) applying a suction draw to the bottom of the forming wire to draw the fines away from the forming wire;
(c) carrying the fines and suction air away from the papermaking machine;
(d) separating the fines from the suction air and collecting the fines in a plurality of separation units;
(e) discharging the collected fines from the separation units one at a time;
(f) conveying the discharge fines mixed with air away from the separation units back to the papermaking machine;
(g) mixing the discharged fines with fresh fiber stock;
(h) laying the mixture of fresh fiber stock and discharged fines carried in air on the forming wire at a position downstream in the direction of forming wire travel from the position where fresh fiber stock is first laid on the forming wire.

* * * * *